United States Patent [19]

Dickinson et al.

[11] Patent Number: 4,527,338

[45] Date of Patent: Jul. 9, 1985

[54] DEVICE FOR INSTALLING AN ARTICLE ON A VERTICAL SURFACE

[76] Inventors: John Dickinson, 8400 Flame Vine Ave. North, Seminole, Fla. 33543; Peter Warhurst, 1894 Del Robles Dr., Clearwater, Fla. 33546

[21] Appl. No.: 582,387

[22] Filed: Feb. 22, 1984

[51] Int. Cl.[3] ..... B25H 7/00

[52] U.S. Cl. ..... 33/180 R; 33/189; 33/161

[58] Field of Search ..... 33/180 R, 161, 169 R, 33/189

[56] References Cited

U.S. PATENT DOCUMENTS

| | | | |
|---|---|---|---|
| 785,432 | 3/1905 | Perkins | 33/180 R X |
| 1,121,290 | 12/1914 | Robinson | 33/180 R X |
| 3,492,737 | 2/1970 | Swanson | 33/189 X |
| 3,724,085 | 4/1973 | Wentworth | 33/180 R X |
| 4,060,905 | 12/1977 | Light | 33/180 R |
| 4,202,108 | 5/1980 | Adams et al. | 33/189 |

OTHER PUBLICATIONS

Kirsch Drapery Hardware General Catalog, published 1977, p. 48 and index page.

Kirsch Drapery Hardware Price List, published Jul. 16, 1983, p. 49 and front page.

*Primary Examiner*—Robert S. Ward

*Attorney, Agent, or Firm*—Frijouf, Rust & Pyle

[57] ABSTRACT

A device for installing an article on a vertical surface. The device includes a base and a first longitudinal member connected to the base. A second longitudinal member is slidable longitudinally relative the first member. The second longitudinal member is in a telescopic relationship with the first longitudinal member enabling the distal end of the second longitudinal member to be varied in vertical height relative to the base. A template frame is secured to the second member and a plurality of punches are disposed in the frame. The device also includes a lock for locking the relative position between the first and the second longitudinal members, enabling an operator to position the template frame a predetermined distance vertically above the base with the template frame being located in contact with the vertical surface to form an aperture in the vertical surface upon depression of at least one of the plurality of punches to install the article on the vertical surface thereby.

23 Claims, 7 Drawing Figures

DEVICE FOR INSTALLING AN ARTICLE ON A VERTICAL SURFACE

BACKGROUND OF THE INVENTION

1. Field of the Invention

This invention relates to a device for installing an article on a vertical surface. More specifically, this invention relates to a drapery rod installation device or the like.

2. Information Disclosure Statement

Professional drape hangars, as well as do-it-yourself enthusiasts, have experienced problems associated with the installation of a pair of drape brackets above a window casement. The usual method employed in the hanging of drapes is to measure and mark on the vertical surface the vertical distance from the floor in accordance with to the length of drapes. This operation is repeated on the opposite side of the window casement in order to locate the correct position for the opposite drape bracket. Not only is this prior method of installing drape brackets time-consuming and inaccurate, but usually it is preferable that two persons be employed in the prior method, because it is necessary for one person to measure the vertical distance for the location of the drape bracket while the other person holds a level to insure that the measure is disposed in a vertical position. With the prior method of installation of drape brackets, once the location of the drape bracket has been determined it is then necessary to mark the location of the fixing holes in the drape bracket so that the wall may be drilled in the correct position such that the bracket may be affixed to the wall. A further problem exists in the prior method of installing drape brackets in that it is essential that the distance between brackets be accurately measured to correspond with the required width of the drapes.

The drapery rod installation device of the present invention overcomes the aforementioned inadequacies of the prior art devices by providing an easily used tool which is readily adjustable for the installation of drape brackets which are used for supporting different lengths of drapes and for enabling the operator at the same time to punch a plurality of holes in the wall which correspond with the required configuration of holes as determined by the particular configuration of the drape bracket.

Various prior art devices have been proposed to facilitate the installation of drape brackets or the like. Among such prior art proposals, U.S. Pat. No. 3,724,085 to Wentworth teaches a drapery rod installation template in which a rib is disposed on the top of a window casing and a rule is moved horizontally relative the rib until drill guides are located at a proper distance from the edge of the casing. At the correct location of the drill guides a drill bit is inserted through the drill guides and appropriate holes are drilled in the wall for the location and fixing of the drape brackets to the wall. The operation is repeated on the opposite side of the window casing. However, not only does this installation device require a separate operation for the drilling of holes in the walls supporting the drape brackets, but also if the window casing is not completely aligned with the floor, the drapes will not hang properly from the drape brackets and support rods.

Similarly, U.S. Pat. No. 2,799,093 to Miller teaches a gauge for hanging window shades. The gauge includes at least two members which are able to slide telescopically relative each other. The members are locked together to form a device of predetermined dimensions to correspond with the width of a drape to be hung. The correctly-adjusted gauge is laid horizontally above the window casing such that the opposite drape brackets may be correctly positioned adjacent the vertical wall above the window. A suitable punch is inserted through the aligned openings in the brackets to indicate the exact position for the screws which are to support the shade brackets. No means is disclosed in the specification for insuring that the opposite brackets are located at exactly the same vertical height from the floor.

U.S. Pat. No. 3,791,041 to Phillips teaches a shelf marking punch which includes a mobile vertically-disposed frame having a plurality of spring-urged punches for providing holes in a vertical wall to accommodate shelf arrangements employed in residential buildings. No disclosure is made in the specification of a means for adjusting the vertical height of the plurality of punches relative to the vertical wall; therefore, such a device could not be used for the installation of different lengths of drapes.

Although the prior art drape hanging devices produce an improvement when compared with the more conventional methods of installation using a ruler and level, nevertheless a need has existed in the art of a simple device which would enable an operator to install a drape bracket quickly and easily at the correct location and to insure that such bracket is positioned laterally at exactly the same vertical position as a bracket installed on the opposite side of the window.

It is the primary object of the invention to provide an adjustable device for the installation of drapes that overcomes the aforementioned inadequacies of the prior art devices and provides an improvement which significantly contributes to the speed and the ease with which an operator may install drape brackets or the like.

Another object of the invention is the provision of a device for installing drapery rods in which the device can be adjusted to accommodate a plurality of drape lengths.

Another object of the present invention is the provision of a device which not only locates the exact vertical position for the drape bracket but also enables the operator to simultaneously punch a hole in the vertical surface in readiness for the installation of the drape bracket.

Another object of the invention is the provision of a device for installing an article on a vertical surface in which an optional linear measure is pivotally mounted on the device to enable the drape bracket to be located in the correct lateral position relative the window.

Another object of the invention is the provision of a device for the installation of an article on a vertical surface in which the device incorporates a spirit level to insure that the device is held in a vertical disposition relative the vertical surface.

Another object of the invention is provision of a device for installing an article on a vertical surface, including a base and a first and a second longitudinal member, the longitudinal members being slidable telescopically relative each other and a template frame secured to the distal end of the second longitudinal member, the template frame including a plurality of punches disposed in a pattern which corresponds with the fixing holes disposed in all the various currently available drapery support brackets.

Another object of the present invention is the provision of a device for installing an article on a vertical surface which may be operated by an operator without assistance.

The foregoing has outlined some of the more pertinent objects of the present invention. These objects should be construed to be merely illustrative of some of the more pertinent features and applications of the invention. Many other beneficial results can be obtained by applying the disclosed invention in a different manner or modifying the invention within the scope of the disclosure. Particularly with regard to the use of the invention disclosed herein, this should not be construed as being limited to devices for installing articles on a vertical surface, but should include drapery rod installation devices and devices for hanging picture frames and the like.

SUMMARY OF THE INVENTION

The device for installing an article on a vertical surface of the present invention is defined by the appended claims with a specific embodiment shown in the attached drawings. For the purpose of summarizing the invention, the invention relates to a method and device for installing an article on a vertical surface. The device includes a base and a first longitudinal member connected to the base. A second longitudinal member is slidable longitudinally relative to the first member, the second longitudinal member being in telescopic relationship with the first longitudinal member, enabling the distal end of the second member to be varied in vertical height relative the base. A template frame is secured to the second member and a plurality of punches are disposed in the frame. The device also includes a lock for locking the relative position between the first and the second members, enabling an operator to position the frame template a predetermined distance vertically above the base with the frame template being located in contact with the vertical surface to form an aperture in the vertical surface upon depression of at least one of the plurality of punches to install the article on the vertical surface thereby.

In a more specific embodiment of the invention, the base includes a planar portion which cooperates with and extends substantially horizontal relative the floor, and an upstanding portion extends angularly relative the planar portion. A pair of spaced supports extend from the upstanding portion and anchoring pins secure the spaced supports relative the first member, such that the first member extends substantially vertically relative the planar portion. The second longitudinal member slides longitudinally within the first member, and both the first and second longitudinal members have a cross-sectional configuration along the longitudinal length thereof, such that the internal cross-sectional configuration of the first longitudinal member is slightly greater than the external cross-sectional configuration of the second member, such that the second member slides longitudinally within the first member and the cross-sectional configuration of the first and the second members are substantially square to inhibit relative rotation between the first and the second members.

The template frame includes a planar support plate, the plate being rigidly connected to the distal end of the second member. The planar plate defines a plurality of bores such that the longitudinal axis of the bores are normal to the planar plate. Each of the plurality of bores slidably receives therein a punch of the plurality of punches. Additionally, the template frame includes cushioning means disposed between the planar support plate and the vertical surface for inhibiting damage to the vertical surface upon the depression of the punches.

Each of the punches is biased away from the vertical surface to a non-operative position for enabling movement of a punch of the plurality of punches into an operable position upon impact applied to one of the plurality of punches. The template also includes an impact plate juxtadisposed relative the planar support plate, with the impact plate defining a plurality of secondly bores. Each of the secondary bores is aligned with a corresponding bore in the planar plate. A stop device is rigidly connected to each of the punches for arresting the biased movement of each of the punches away from the vertical surface. Counterbores are defined by the planar support plate for the slidable reception of a reamer, which extends from each of the punches such that the punch can slide relative the temperature upon impact applied to a corresponding punch to provide the corresponding hole in the vertical surface. The template further includes a washer disposed coaxial around each of the punches and between the planar support plate and the impact plate, the washer reacting with the stop device for arresting the biased movement of the adjacent punch away from the vertical surface. The lock further includes a pin, a spring biased device for urging the pin transversely through a hole defined by the first member such that the pin engages one of the plurality of indentations defined by the second member. The indentations are spaced along the length of the second member. The lock also includes a finger actuable means connected to the pin for permitting the pin to be pulled out of engagement with the indentations to adjust the predetermined distance of the frame from the base.

The device further includes a scale pivotally connected to the second member for measuring laterally relative the second member. The device further includes a spirit level rigidly connected to the device for locating the device in a vertical position. In alternative embodiments of the present invention, the lock may include a threaded locking device for locking the first and the second members together, and the linear scale may be pivotally connected to the template frame for selectively measuring laterally along the vertical surface on either side of the frame.

The present invention also provides a method of installing an article on a vertical surface, the method including the steps of positioning the base on the floor with the base disposed adjacent the vertical surface and the first member extending vertically from the base. The lock is released such that the second member may be pulled longitudinally relative the first member until the template frame is disposed against the vertical surface at the required predetermined distance vertically above the base. The appropriate punches are then struck with a striking tool to punch a first set of holes in the vertical surface at the desired location such that a drape-supporting bracket may be secured adjacent the vertical surface. The device is moved laterally to a location suitable for securing another drape-supporting bracket on the other side of the window, and finally, the appropriate punches are struck with the striking tool to ream a second set of holes in the vertical surface at the same vertical distance from the floor as the first set of holes.

The foregoing has outlined rather broadly the more pertinent features of the present invention in order that the detailed description of the invention that follows may be better understood so that the present contribution to the art can be more fully appreciated. Additionally, features of the invention will be disclosed or described hereinafter which form the subject of the claims of the invention. It should be appreciated by those skilled in the art that the conception and specific embodiments disclosed may be readily utilized as a basis for modifying or designing other devices for carrying out the same purposes of the present invention. It should be realized by those skilled in the art that such equivalent constructions do not depart from the spirit and scope of the invention set forth in the appending claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts through the several views of the drawings.

DETAILED DESCRIPTION

Figure 1:
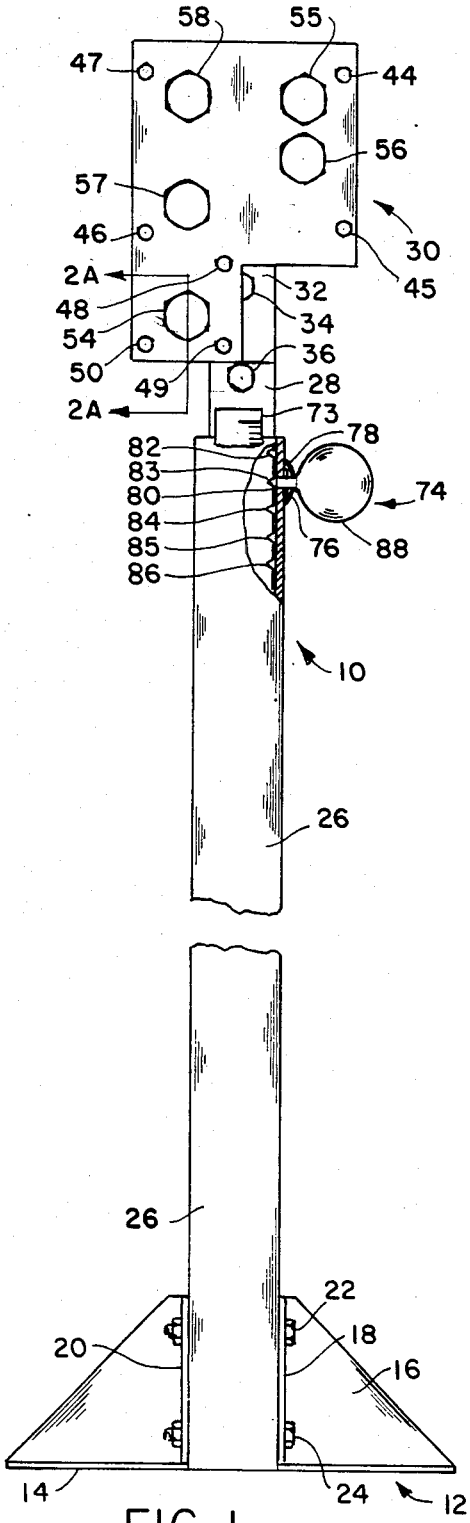
FIG. 1 is a front elevational view of the drapery rod installation device of the present invention.

FIG. 1 is a front elevational view of the device generally designated 10 for installing an article on a vertical surface. The device 10 includes a base generally designated 12. The base 12 includes a planar portion 14 which cooperates with and extends substantially horizontally relative a horizontal surface, such as a floor or ceiling. An upstanding portion 16 of generally trapezoidal configuration extends angularly relative the planar portion 14. A pair of spaced supports 18 and 20, respectively, are spaced parallel relative each other and extend from the upstanding portion 16. Anchoring bolts 22 and 24, respectively, extend through the spaced supports 18 and 20 to anchor a first longitudinal member 26 between the supports 18 and 20 such that the first longitudinal member 26 extends substantially vertically relative the planar portion 14.

A second longitudinal member 28 is slidable longitudinally relative the first member 26. The first longitudinal member 26 is preferably of substantially square, tubular cross sectional configuration, the internal transverse cross-sectional area of the first member 26 being slightly greater than the external square cross-sectional area of the second member 28, such that the second member 28 may slide longitudinally relative to and within the first longitudinal member 26. Because the first and second members 26 and 28 respectively are substantially square in transverse cross-sectional area, the second member 28 is prevented from rotating axially within the first longitudinal member 26. A template frame generally designated 30 is rigidly connected to the distal end 32 of the second member 28 by means of two fastening devices 34 and 36, respectively. The template frame 30 includes a planar support plate 38, an impact plate 40, and a connector plate 42. The plates 38, 40 and 42 are connected together in juxtadisposition parallel relative each other by means of threaded fasteners 44 to 50. The planar support plate 38 and impact plate 40 define a plurality of bores, one of which is shown and designated 52, as shown in FIG. 2 and FIG. 2A.

The longitudinal axis of each of the bores is normal to the planar plate 38. A plurality of punches 54 to 58 are slidably received within the bores within the planar support plate 38. The connecting plate 42 is preferably faced with a strip of felt 43 and is connected to the planar plate 38 and the distal end 32 of the second member 28, such that the strip of felt 43 rests against and is a cushioning means to protect the vertical surface when the template frame 30 is pressed against the vertical surface.

Figure 2:
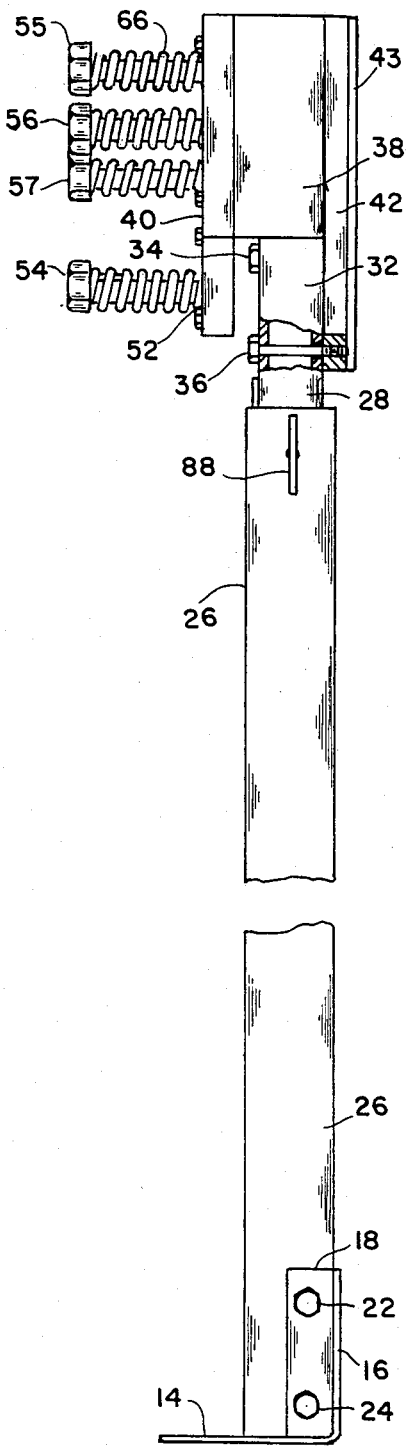
FIG. 2 is a right side elevational view of the device shown in FIG. 1.
Figure 2A:
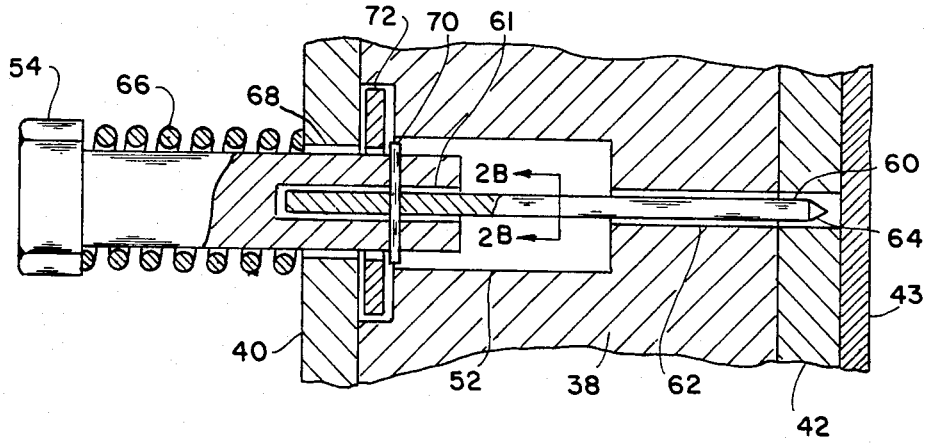
FIG. 2A is an enlarged sectional view of one of the reamers taken on the line 2A—2A of FIG. 1.

The punches 54 to 58 each include a reamer, one of which is designated 60, and is shown in FIG. 2 and FIG. 2A as extending from the punch 54. The reamer 60 extends normal to the planar plate 38 through a counterbore 62 defined by the planar plate 38 and the connector plate 42 and the felt 43. The reamer 60 includes a cutter point 64 defined by the distal end of the reamer 60. The cutter point 64, cooperating with the vertical surface to ream a drape bracket support hole therein. A compression spring 66 biases the punch 54 into a non-operative position with the cutter point 64 retracted from the vertical surface. As shown in FIG. 2 and FIG. 2A, a secondary bore 68 defined by the impact plate 40 is aligned with, and is of the same dimensions as, the bore 52 such that the punch 54 may move longitudinally through the bores 68 and 52. A stop pin 70 extends transversely through the punch 54 to arrest the biased movement of the punch 54 away from the vertical surface. The stop pin 70 abuts against a washer 72 disposed coaxially with the reamer 54 and is located between the impact plate 40 and the planar plate 38.

A metal rule 73 is riveted or otherwise permanently attached to the front face of the second longitudinal member 28 such that the distance between the planar portion 14 of the base 12 and the various sets of reamers can be calibrated for a particular height of drapery to be installed.

Figure 2B:
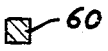
FIG. 2B is a sectional view of one of the reamers taken on the line 2B—2B of FIG. 2A.

FIG. 2B is a sectional view of the reamer 60 which is substantially of square transverse cross-sectional configuration. The reamer 60 may be removed and replaced by the removal of the pin 70 which locks the reamer 60 within a bore 61 defined by the reamer 54.

A locking device generally designated 74 includes a tumbler 76 which is biased by a spring 78 to urge the tumbler 76 transversely through a hole 80 defined by the first member 26, such that the tumbler 76 engages one of a plurality of indentations 82 to 86 defined by and spaced along the length of the second member 28. A finger actuatable handle 88 is rigidly connected to the tumbler 76 for permitting the tumbler 76 to be pulled out of engagement with the indentations 82 to 86 to adjust the pre-determined distance of the template frame 30 from the base 12.

Figure 3:
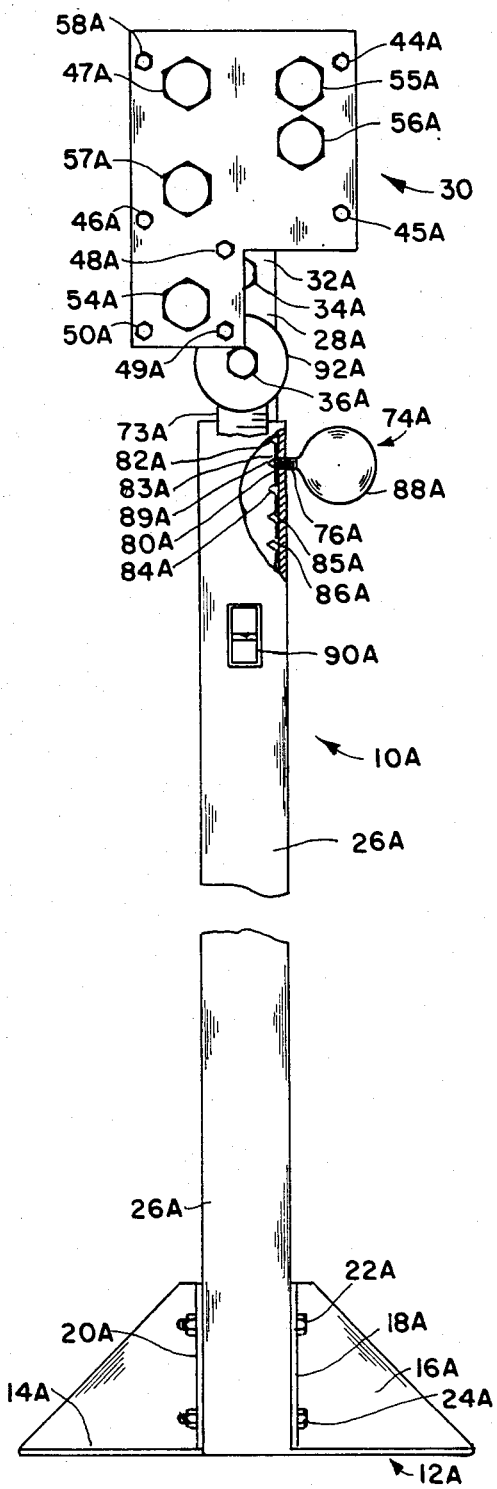
FIG. 3 is a front elevational view of an aternative embodiment of the device shown in FIG. 1.

In an alternative embodiment of the present invention as shown in FIG. 3, similar parts are referred to with the corresponding similar numeral to those of the foregoing embodiments, together with the suffix A. In the alternative embodiment shown in FIG. 3, the locking means 74A includes a rod 76A, which threadably engages and corporates with a threaded bore 80A defined by the first longitudinal member 26A. By turning the finger actuatable device 88A the distal end 89A of the pin 76A is urged into contact with one of the indentations 82A to 86A to lock the first and the second members 26A and 28A together such that the template frame 30A is fixed at a predetermined vertical distance relative the base 12A.

Additionally, in the alternative embodiment as shown in FIG. 3, a spirit level 90A is connected to the first longitudinally member 26A for maintaining the member 26A in a vertical position relative the vertical surface during the installation procedure.

In addition to the spirit level 90A a linear scale such as a flexible extending metallic rule having a scale printed thereon is designated 92A. The scale or rule 92A is pivotally connected to the second member 28A. The scale or rule 92A is pivotally to the second member 28A such that the rule 92A pivots or rotates around the bolt 36A. With this arrangement, the scale means 92A may be pivoted about the second member 28A such that when the device 10A is positioned on one side of the window the scale 92A may be extended laterally relative the device 10A to measure a lateral distance from the device 10A.

Figure 4:
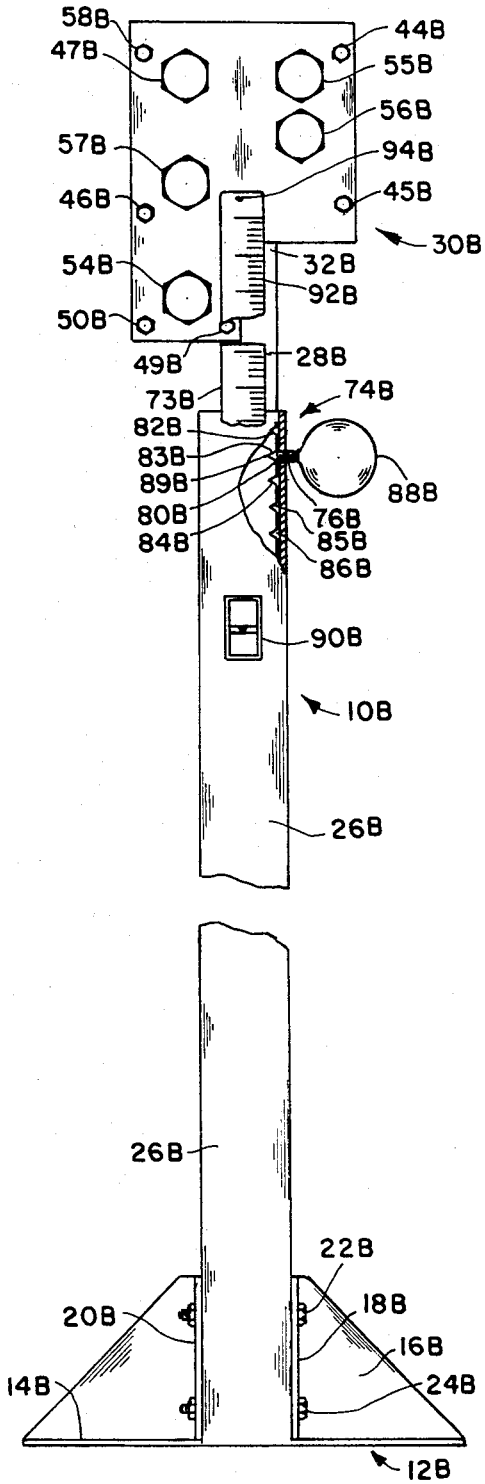
FIG. 4 is a front elevational view of a further alternative embodiment of the device shown in FIG. 1.

In a further alternative embodiment of the present invention as shown in FIG. 4, the scale means 92B is a rigid linear means which is pivotally connected about a pivot pin 94B such that the scale means 92B may be pivoted laterally relative the device 10B in either direction to measure a distance laterally relative the device 10B.

Figure 5:
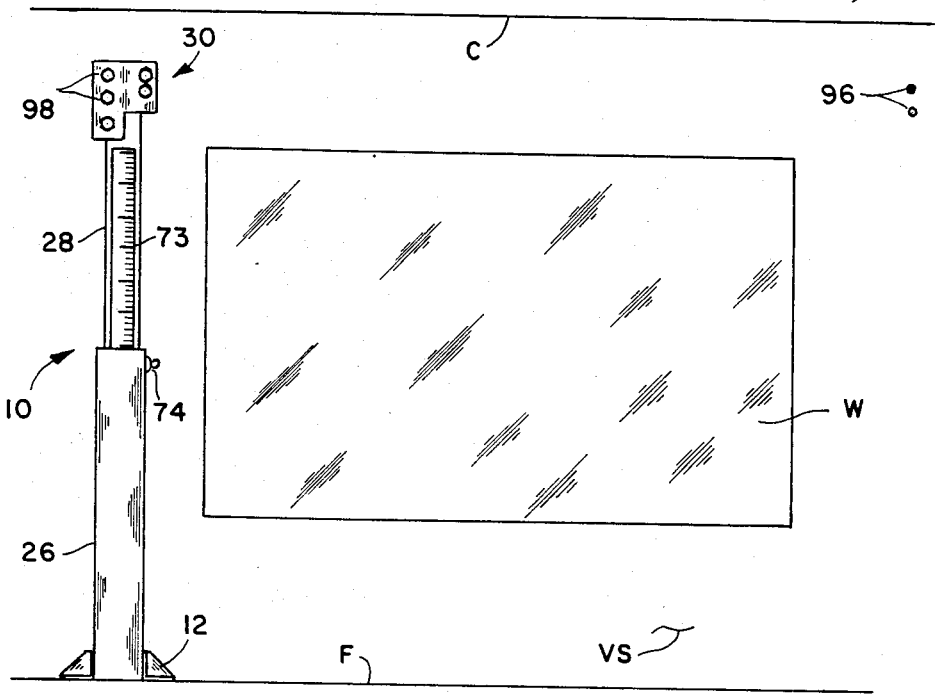
FIG. 5 is a diagrammatic representation of the device showin in FIG. 1 when used to install a drape bracket adjacent a window.

FIG. 5 is a diagramatic representation of the device 10 when used to install a pair of drape-supporting brackets to a vertical surface. The vertical surface in FIG. 5 is represented by the letters VS; the floor is represented by the letter F; the window is represented by the letter W; and the ceiling is represented by the letter C. In operation of the device 10 as shown in FIG. 5, the device 10 is placed with the base 12 adjacent the floor F, and the first set of holes 96 corresponding withe the holes in the drape bracket to be used are punched in the vertical surface on the right hand side of the window W. The device 10 is then moved to the position as shown in FIG. 5 with the device located to the left of the window W, and a second set of holes 98 are punched in the vertical surface VS at exactly the same height vertically from the floor F as the first set 96. If the device is then used for installing drape brackets of a different hole configuration adjacent another window, the same operation is repeated, but using a different combination of the punches 54 to 58 to correspond with the holes in the required bracket.

In the drape to be installed at another window is of a different length, then the lock 74 is released to permit the template frame 30 to be moved vertically to the required disposition of the template relative the base 12.

The present invention provides a device for installing drapery rods and the like to a vertical surface that is not only very simple to operate but also enables the operator to install drape rods at a plurality of vertical heights to accommodate drapes of varying lengths. The device of the present invention also provides means for punching holes in the vertical surface in an appropriate configuration to correspond with currently-available drape brackets. The device is simple to use and is of rugged construction and has been demonstrated to greatly increase the speed with which professional installers of window drapes can install drapee brackets in order to hang drapes therefrom.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A device for installing an article on a vertical surface, said device comprising:
   - a base;
   - a first longitudinal member connected to said base;
   - a second longitudinal member slidable longitudinally relative said first member;
   - means for establishing said second longitudinal member in a telescopic relationship with said first longitudinal member enabling the distal end of said second longitudinal member to be varied in vertical height relative said base;
   - a template frame secured to said second member;
   - a plurality of punches disposed in said frame; and
   - locking means for locking the relative position between said first and said second longitudinally-extending members, enabling an operator to position said template frame a pre-determined distance vertically above said base with said template frame being located in contact with the vertical surface to form an aperture in the vertical surface upon depression of at least one of said plurality of punches to install the article on the vertical surface thereby.

2. A device as set fourth in claim 1 wherein said base further includes:
   - a planar portion, said planar portion cooperating with and extending substantially horizontally relative a horizontal surface;
   - an upstanding portion, said upstanding portion extending angularly relative said planar portion;
   - a pair of parallel spaced supports, said supports extending from said upstanding portion; and
   - anchoring means for securing said spaced supports relative said first member such that said first member extends substantially vertically relative said planar portion.

3. A device as set forth in claim 2 wherein said horizontal surface is a floor.

4. A device as set forth in claim 2 wherein said horizontal surface is a ceiling.

5. A device as set forth in claim 1 wherein said second longitudinal member slides longitudinally within said first member.

6. A device as set forth in claim 1 wherein said means for establishing said second longitudinal member in a telescopic relationship with said second member includes:
   - said first member being tubular and having an internal cross-sectional configuration along the longitudinal length thereof slightly greater than the external cross-sectional configuration of said second member such that said second member slides longitudinally within said first member.

7. A device as set forth in claim 1 further including:
means for inhibiting relative rotation between said first and said second members.

8. A device as set forth in claim 6 wherein said cross-sectional configuration of said first and said second members is substantially square for inhibiting relative rotation between said first and said second members.

9. A device as set forth in claim 1 wherein each of said plurality of punches is disposed in a configuration to accommodate a plurality of currently available drape brackets upon punching selected ones of said plurality of punches.

10. A device as set forth in claim 1 wherein said template frame further includes:
a planar support plate, said plate being rigidly connected to the distal end of said second member, said plate defining a plurality of bores such that the longitudinal axis of said bores are normal to said planar plate, each of said plurality of bores slidably receiving therein a punch of said plurality of punches.

11. A device as set forth in claim 10 wherein said template frame further includes:
a cushioning means disposed between said planar support plate and the vertical surface for inhibiting damage to the vertical surface upon said depression of said punches.

12. A device as set forth in claim 11 wherein said cushioning means is a strip of felt.

13. A device as set forth in claim 1 further including:
biasing means for biasing said punches away from the vertical surface to a non-operative position and for enabling movement of a punch of said plurality of punches into an operable position upon impact applied to one of said plurality of punches.

14. A device as set forth in claim 11 further including:
a biasing means disposed in each of said bores for biasing said punch disposed within said bore into a non-operative position away from the vertical surface;
an impact plate juxtadisposed parallel relative said planar support plate;
means for securing said impact plate relative said planar plate;
secondary bores defined by said impact plate, each of said secondary bores being aligned with a corresponding bore of said planar plate; and
stop means rigidly connected to each of said punches of arresting the biased movement of each of said punches away from the vertical surface.

15. A device as set forth in claim 14 further including:
a counterbore defined by said planar support plate, said counterbore being coaxial with and extending from each of said bores;
a reamer extending from each of said punches, each reamer slidably extending through one of said counterbores; and
a punching point defined by the end of said reamer remote from said impact plate.

16. A device as set forth in claim 15 further including:
a washer disposed coaxially around each of said punches and between said planar support plate and said impact plate, said washer reacting with said stop means for arresting the biasing movement of an adjacent punch away from the vertical surface.

17. A device as set forth in claim 1 wherein said locking means further includes:
a tumbler;
spring biasing means for urging said tumbler transversely through a hole defined by said first member such that said tumbler engages one of a plurality of indentations defined by and spaced along the length of said second member; and
handle means connected to said tumbler for permitting said pin to be pulled out of engagement with said indentations to adjust said predetermined distance of said frame from said base.

18. A device as set forth in claim 1 wherein said locking means further including:
a threaded locking device for locking said members together.

19. A device as set forth in claim 1 further including:
a rule means pivotally connected to said second member, for measuring laterally relative said second member.

20. A device as set forth in claim 1 further including:
a rule means pivotally connected to said template frame for selectively measuring laterally along the vertical surface on either side of said frame.

21. A device as set forth in claim 1 further including:
a spirit level rigidly connected to said device for permitting the maintenance of the device in a vertical position.

22. A method of installing an article on a vertical surface, said method including the steps of:
positioning the base on the floor with the base disposed adjacent the vertical surface and the first member extending vertically from the base;
releasing the lock such that the second member may be pulled longitudinally relative the first member until the template frame is disposed against the vertical surface at the required predetermined distance vertically above the base;
striking the appropriate punches with a striking tool to ream a first set of holes in the vertical surface at the desired location such that a drape supporting bracket may be secured adjacent the vertical surface;
moving the device laterally to a location suitable for securing another drape supporting bracket; and
striking the appropriate punches with the striking tool to ream a second set of holes in the vertical surface at the same vertical distance from the floor as the first set of holes.

23. A method of installing an article on a vertical surface, said method including the step of:
positioning the base on the horizontal surface with the base disposed adjacent the vertical surface and the first member extending vertically from the base;
releasing the lock such that the second member may be pulled longitudinally relative the first member until the template frame is disposed against the vertical surface at the required predetermined distance vertically above the base;
striking the appropriate punches with a striking tool to ream a first set of holes in the vertical surface at the desired location such that a drape supporting bracket may be secured adjacent the vertical surface;
moving the device laterally to a location suitable for securing another drape supporting bracket; and
striking the appropriate punches with the striking tool to ream a second set of holes in the vertical surface at the same vertical distance from the floor as the first set of holes.

* * * * *

UNITED STATES PATENT AND TRADEMARK OFFICE

CERTIFICATE OF CORRECTION

PATENT NO. : 4,527,338

DATED : July 9, 1985

INVENTOR(S) : John Dickinson and Peter Warhurst

It is certified that error appears in the above-identified patent and that said Letters Patent are hereby corrected as shown below:

Column 4, line 21, delete "temperature" and insert therefore --template--.

Column 7, line 24, after "92A is pivotally" insert --connected--.

Column 7, line 34, delete "means" and insert therefore --measure--.

Column 7, line 47, delete "withe" and insert therefore --with--.

Column 7, line 60, delete "In" and insert therefore --If--.

Column 8, line 7, delete "drapee" and insert therefore --drape--.

Column 9, line 65, delete "biasing" and insert therefore --biased--.

Signed and Sealed this

*Twenty-second* Day of *October 1985*

[SEAL]

*Attest:*

*Attesting Officer*

DONALD J. QUIGG

*Commissioner of Patents and Trademarks—Designate*